US009534417B2

(12) United States Patent
Green

(10) Patent No.: US 9,534,417 B2
(45) Date of Patent: Jan. 3, 2017

(54) SAFETY BARRIER FOR A DECK OR PORCH

(71) Applicant: Marhaygue, LLC, Pawleys Island, SC (US)

(72) Inventor: Guerry E. Green, Georgetown, SC (US)

(73) Assignee: Marhaygue, LLC, Pawleys Island, SC (US)

( * ) Notice: Subject to any disclaimer, the term of this patent is extended or adjusted under 35 U.S.C. 154(b) by 0 days.

(21) Appl. No.: 15/015,589

(22) Filed: Feb. 4, 2016

(65) Prior Publication Data

US 2016/0222694 A1 Aug. 4, 2016

Related U.S. Application Data

(60) Provisional application No. 62/111,881, filed on Feb. 4, 2015.

(51) Int. Cl.

| | |
|---|---|
| ***E04H 17/02*** | (2006.01) |
| ***E04H 17/08*** | (2006.01) |
| ***E04H 17/16*** | (2006.01) |
| ***E01F 13/02*** | (2006.01) |

(52) U.S. Cl.

CPC ..... *E04H 17/02* (2013.01); *E01F 13/028* (2013.01); *E04H 17/08* (2013.01); *E04H 17/165* (2013.01)

(58) Field of Classification Search

CPC ..... E04H 17/02; E04H 17/10; E04H 17/12; E04H 17/165; E06B 2009/002; E06B 2009/527; E06B 9/52; E06B 9/521; F16B 5/0692; Y10T 403/7062

See application file for complete search history.

(56) References Cited

U.S. PATENT DOCUMENTS 4,120,785 A * 10/1978 Kanamori ..... B07B 1/4609 209/392
4,631,786 A * 12/1986 Curry ..... E06B 3/24 160/392
4,736,563 A * 4/1988 Bilhorn ..... A01G 9/14 47/17
4,817,655 A * 4/1989 Brooks ..... E04H 15/58 135/119
4,899,797 A 2/1990 Green
5,454,403 A * 10/1995 Kerr ..... B22F 3/002 139/35

(Continued)

FOREIGN PATENT DOCUMENTS

EP 1503009 A1 * 2/2005 ..... E04D 5/146

*Primary Examiner* — Matthieu Setliff

(74) *Attorney, Agent, or Firm* — Michael A. Mann; Nexsen Pruet, LLC

(57) ABSTRACT

A safety barrier is formed of framing, including a guard rail that defines the infill below the rail without the use of pickets. The infill is covered with mesh screen, which may be made of nylon which has greater tensile strength than conventional fiberglass. The mesh screen is held to the framing by an extruded base. The base has a central channel between two flat spline grooves. Flat splines hold mesh screen in their respective grooves more securely than conventional friction-based channel splines. A metal plate is positioned in the central channel to enables screws that secure the base to be tightened to hold it to the framing better. The elimination of pickets in the infill leaves the view unobstructed and allows other treatments of that portion of a deck or porch that are more aesthetically pleasing without compromising safety.

17 Claims, 5 Drawing Sheets

(56) References Cited

U.S. PATENT DOCUMENTS

| | | | | | |
|---|---|---|---|---|---|
| 5,843,542 | A * | 12/1998 | Brushafer | F16L 11/02 | 138/123 |
| 6,076,448 | A * | 6/2000 | Rexroad | E04H 17/02 | 256/45 |
| 6,431,368 | B1 * | 8/2002 | Carr | B01D 33/0093 | 209/401 |
| 7,222,467 | B2 | 5/2007 | Nowell et al. | | |
| 7,526,902 | B2 | 5/2009 | Green | | |
| 7,682,996 | B2 * | 3/2010 | Carr | B01D 33/0093 | 209/401 |
| 7,861,473 | B1 | 1/2011 | Green | | |
| 8,042,598 | B2 | 10/2011 | Bredemus et al. | | |
| 8,056,602 | B1 | 11/2011 | Green | | |
| 2016/0101333 | A1 * | 4/2016 | McCampbell | A63B 59/20 | 473/513 |

* cited by examiner

SAFETY BARRIER FOR A DECK OR PORCH

TECHNOLOGICAL FIELD

The disclosure relates generally to the decks and porches. In particular, it relates to the infill below the guardrails of decks and porches.

BACKGROUND

A deck or porch can extend the livable area of a home considerably. Because decking and porches are oftentimes elevated with respect to the surrounding ground, the risk of falling off the deck or porch must be considered. Commonly, a guard rail is constructed at about waist height to prevent falling. However, a child or a seated adult could still fall from the deck despite the guard rail. To prevent this type of injury, pickets, narrow spaced-apart pieces of lumber, are fastened perpendicularly to the guardrail. Even in porches where typical mesh screening is attached below the guard rail, pickets are nonetheless necessary for safety because mesh screening cannot be counted on to prevent someone from falling off the porch or deck. Mesh screening may tear or come loose when subjected to lateral impact.

The area below the guard rail in a porch is referred to as infill. Two typical building code requirements apply to the infill. First, the infill section must be able to prevent a sphere of 10 cm (4 inches) from passing through any part of the infill. Second, when a 125-pound load is applied to a one-square-foot area, from either direction, the infill must not disengage from its framework. Pickets will meet that requirement when placed not more than 4 inches (10 cm) apart. Unfortunately, pickets partially obstruct the view from the deck and are an inconvenience to maintain. They also foreclose any alternate, aesthetic appearance for a deck or porch.

An infill that is safe but avoids the use of pickets would have several useful advantages.

SUMMARY

The present disclosure describes a safety barrier for the infill area, one that withstands lateral forces and can meet code requirements, but without the use of pickets or other obstructions to the view. In particular, use of a mesh with greater tensile strength and a better securement of the mesh to the framing yields the desired strength to prevent falling. Moreover, use of the present safety barrier does not preclude other, more aesthetic treatment of the infill area.

The safety barrier for a deck or porch, according to the present disclosure, includes framing that defines an opening, which is the infill area. A mesh screen having plural strands of at least one material cover the opening. The material is selected to have a greater tensile strength than conventional screening material, which is fiberglass. A convenient choice for the present material is nylon. Other materials can be used including a mixture of conventional screening material and stronger materials in a suitable pattern that provides sufficient overall tensile strength.

To hold the mesh screen to the framing, a base is attached to the framing. The base provides greater resistance to the pull on the mesh from a lateral impact. The base is configured with at least one spline groove and a central channel parallel to and between plural spline grooves. Each spline groove has a spline. The splines are not round and do not hold the marginal portion of the screen by friction. Rather they are flatter and longer and the spline groove is larger in its interior than at its entrance. There is thus an overhang at the entrance and the entrance is just large enough for the edge of the spline groove to be inserted and then rotate so that it is pressed against the overhang. In this position, the marginal portion of the mesh screen is not likely to be pulled free.

A metal plate may be added to the central groove to act as a washer in holding the base to framing. Fasteners, such as screws hold the base to the framing and the metal plate allows the screws to be turned more tightly without damaging the base.

Another aspect of the disclosure is a cap fastened to the base so it covers the base. The cap locks to the base but can be pried off.

Still another feature of the invention is that if pickets are not needed, so a more decorative treatment of the space between the guard rail and the balance of the framing can be used.

These and other features and their advantages will be apparent to those skilled in the art of porch construction and screening from a careful reading the detailed description accompanied by the following drawings.

BRIEF DESCRIPTION OF THE DRAWINGS

In the Figures

DETAILED DESCRIPTION

A deck is a surface adjacent to a home that extends the livable space into the out-of-door. Decks are often elevated above the surrounding ground so that they are at the same level as the interior of the home. Because of that elevation, a deck may include a guard rail, set about waist height. The guard rail is supported by posts set at intervals along the perimeter of the deck.

In a porch that is to be covered in mesh screening, wood or other similar material is used to frame the porch, that is, structural members are installed on the porch to divide the perimeter between the porch floor and the roof over the porch into openings which are individually covered with mesh screens.

In both porches and decking, framing is used, for the guard rail in the instance of decks and for the exterior porch wall in the case of porches. The framing is typically made of wood structural members fastened together, including vertical posts and horizontal rails. The term framing is used herein to indicate structural, load-bearing elements, typically, but not always, made of wood, and fastened in place along the perimeter of a porch or deck and which elements when so fastened, define rectangular openings, which may include both upper openings above a rail and lower openings. Framing may be standard-sized lumber cut to convenient lengths and may be treated, stained, painted, or coated in some way to preserve the appearance and structural integrity of the framing when exposed to weather over an extended period of time.

In the case of both decking and porches, it is the lower openings, from and including the guard rail down, that the present disclosure is concerned. This is the infill area which becomes a safety concern when the deck or porch is elevated by more than a few feet. The particular safety concern is the risk of a fall against the infill area.

In the infill area, the present invention is a safety barrier that provides protection from falls through the infill. Furthermore, the protective barrier avoids the need for prior art pickets and, in addition, eliminates the obstruction of pickets to the view through the infill.

The primary covering is mesh screening. The term mesh screen refers to a woven product made of thin strands made of metal or plastic. The weave of the mesh is an open weave, commonly a basket weave, so that air and light may pass readily through it, but ideally, the weave is a sufficiently close to limit or prevent insects from passing through it.

Figure 2:
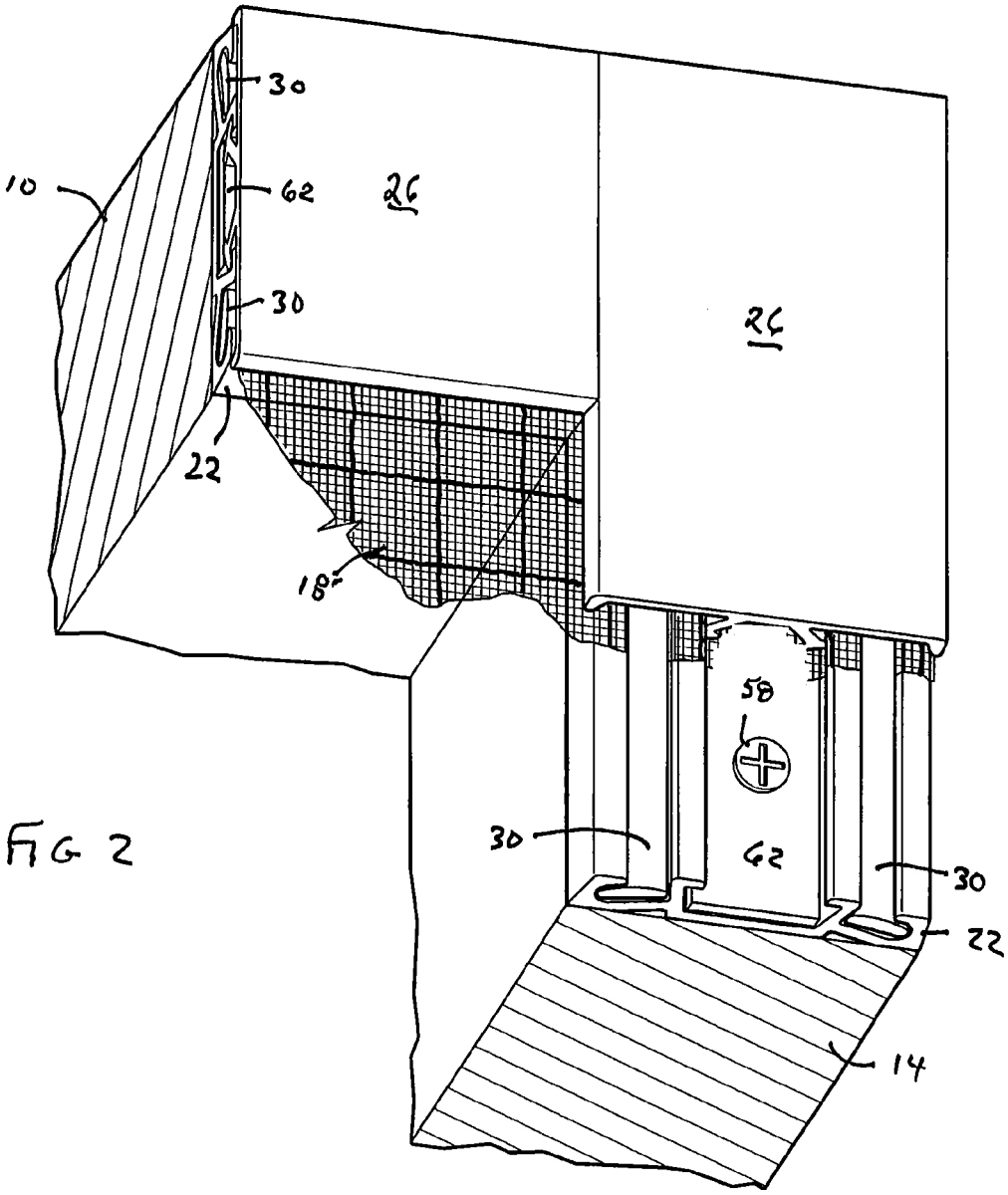
FIG. 2 is a detail of the lower portion showing the guard rail mesh screen attached to the framing elements, according to an aspect of the disclosure.

Rather than conventional mesh screening, however, which can tear, the present barrier uses mesh screening made of a material having greater tensile strength than the conventional material used, which is fiberglass. Many stronger materials exist. For the present mesh screen where greater tensile strength is required, nylon, polyester, bronze, para-aramids, and carbon fiber may be used. Nylon is a stronger material than fiberglass and is not unduly expensive and is readily available. As shown in FIG. 2, mesh 18' may be made of mixtures of strands with one type of strand having a higher tensile strength or a greater thickness than the other strands of mesh 18'. For convenience, strands of higher tensile strength are illustrated in FIG. 2 as thicker than strands of a material with lower tensile strength, but may have higher tensile strength as a result of a different composition regardless of thickness than the composition of the second type of strands. For example, strands of fiberglass and nylon or para-aramids may be used in a mesh-within-a-mesh design.

The term strand refers to a thin, long, flexible, wire-like device, that may be circular in cross section but which has a length very much greater than its diameter and which can be woven with other threads in a basket weave pattern. For example, strands of one stronger material may be used on a 10 cm by 10 cm basis, which means one vertical strand of the stronger material every 10 cm and one horizontal strand of the stronger material every 10 cm and strands of a second material between them.

Alternatively, other arrangements may be made such as using strands of the stronger material only in a vertical orientation and strands of the other material only in a horizontal orientations, or vice versa. Still other possibilities include the use of combinations of strands in one direction but only strands of the stronger material in the orthogonal direction, or the use of different sequences of strands 12, 14, horizontally than the sequence of them used vertically. To stop insects, spacing between strands 12 and 14 must remain small enough, for example, at most a few millimeters. A modest amount of experimentation can determine if a particular material or combination of material in a particular pattern is sufficient by testing it against code requirements as first stated above.

It is not enough for the mesh screen to be stronger, although the mesh screen must not tear when subject to lateral impact. The manner of securing the marginal portion of the mesh screening to the framing is also important. The marginal portion of the mesh screening is the portion of the mesh screen beyond that required to fit the opening that is for use in attaching the mesh screen to the framing.

Figure 1:
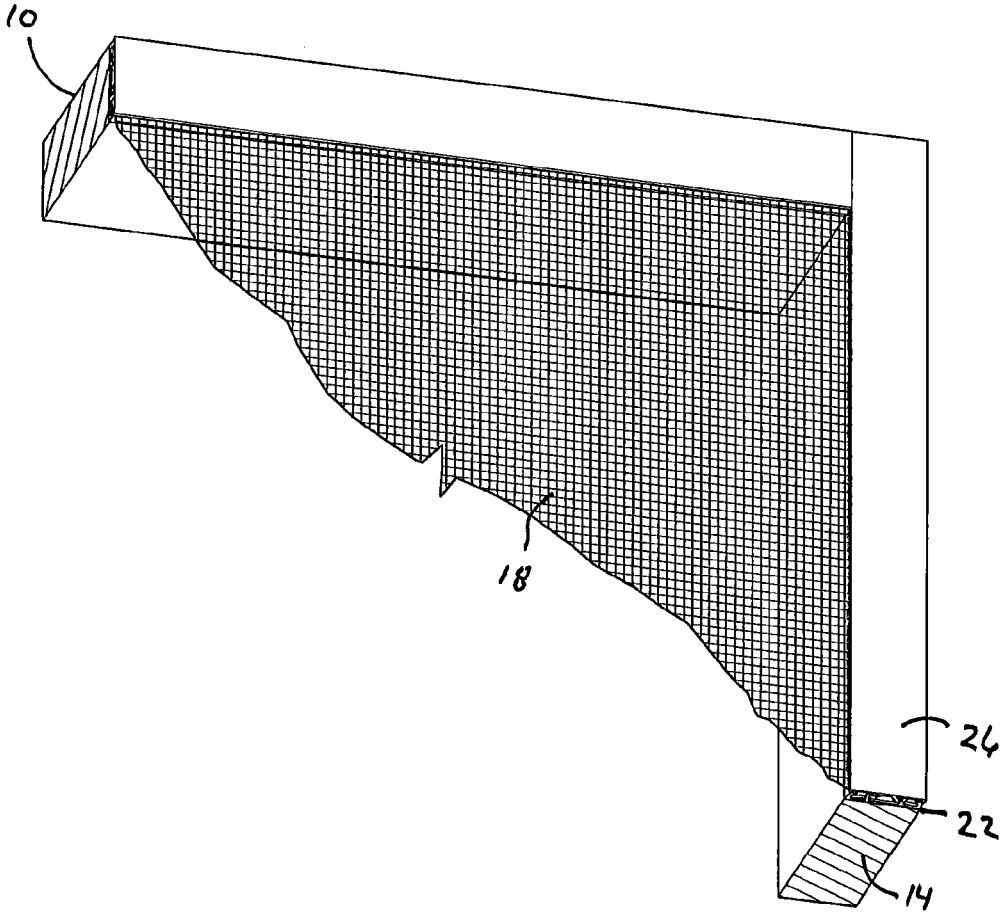
FIG. 1 is a portion of a porch wall showing upper portions and lower portions with two types of mesh screen, according to an aspect of the disclosure.
Figure 3A:
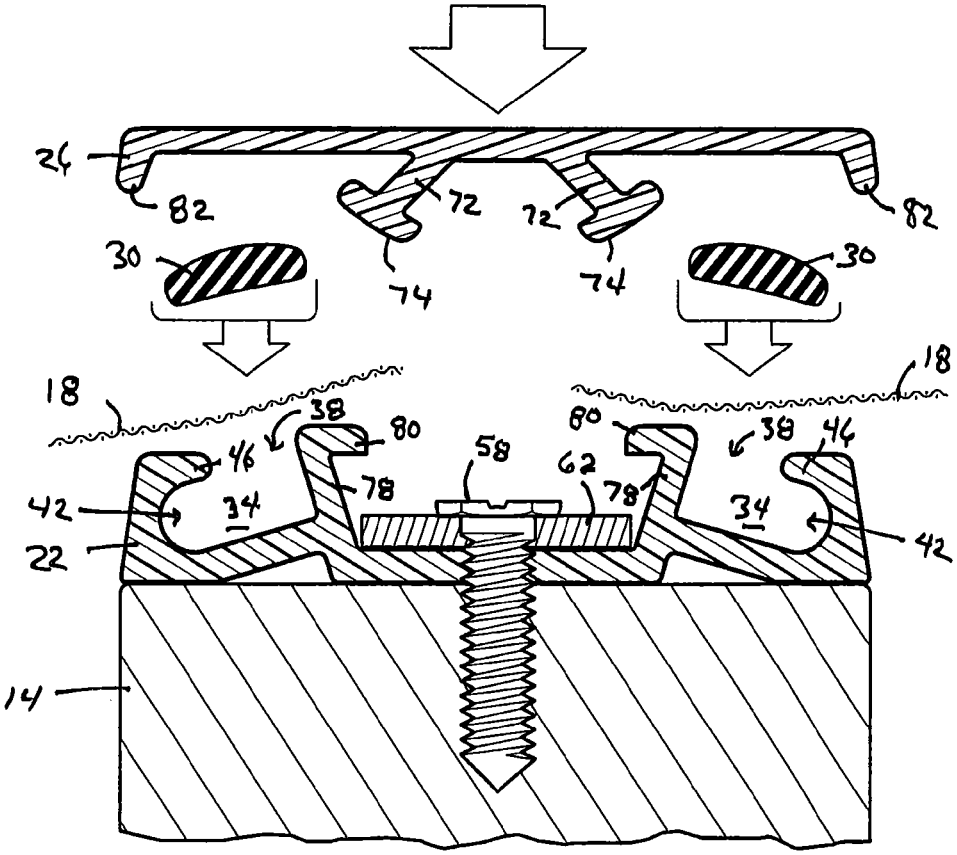
FIGS. 3A, 3B, and 3C show a sequence of views of the mode of attachment of the guard rail mesh to a framing element, according to an aspect of the disclosure.
Figure 3B:
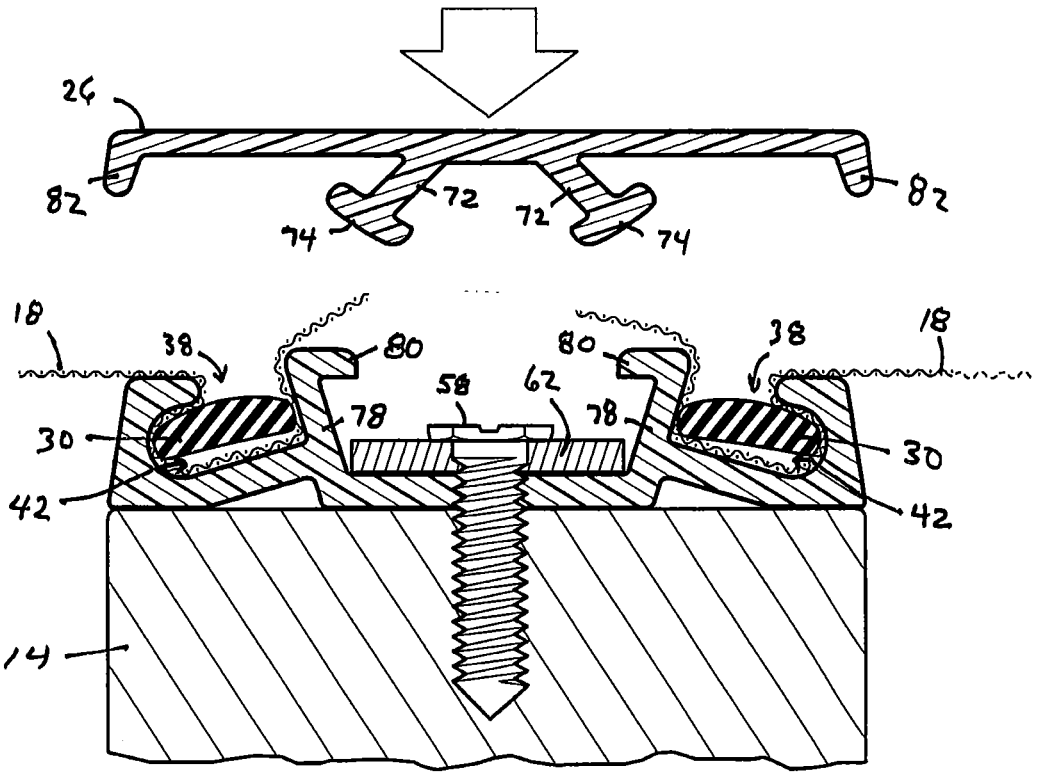
Figure 3C:
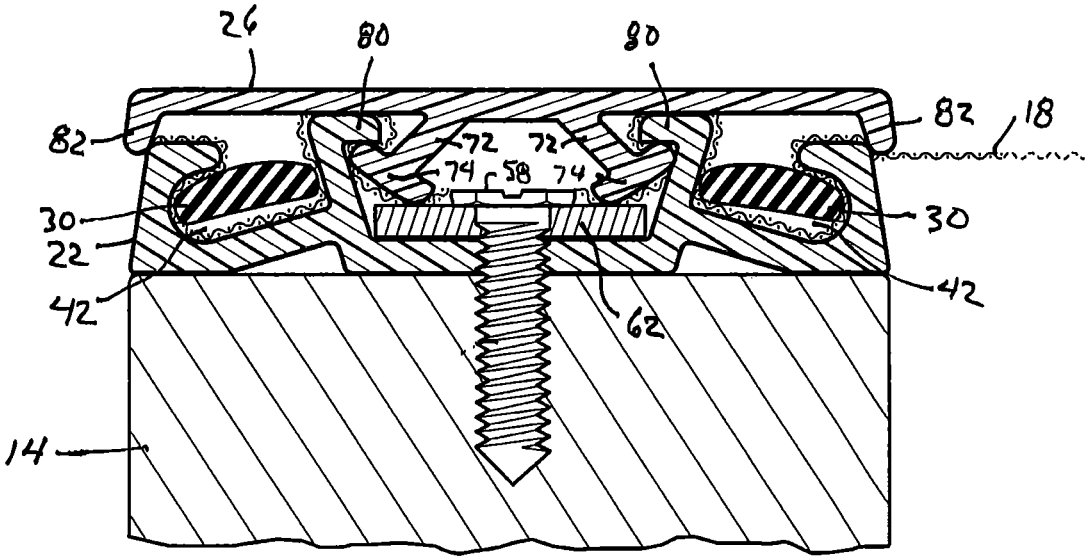

Referring now to the figures, FIG. 1 illustrates a portion of a guard rail 10 and framing 14 with a mesh screen 18 attached using a base 22 with a cap 26 attached to it. FIG. 2 shows a portion of a guard rail 10 and framing 14 with a variation of mesh screen 18' and with a part of cap 26 cut away to show base 22, mesh screen 18', and splines 30 more clearly. FIGS. 3A-3C illustrate in end views the manner in which base 22, splines 30 and cap capture and hold mesh screen 18.

To attach the present mesh screening to guard rail 10 and framing 14, base 22 is first secured to them. Base 22 may be made of extruded material such as vinyl and formed to have spline grooves 34 for receiving the marginal portion of mesh screening. Splines 30 are used to hold the marginal portion of mesh screen 18 in spline grooves 34 and are made of synthetic or natural rubber.

Spline 30 may be a flat spline and spline groove 34 may be a flat spline groove with a rectangular cross section, but may more generally have a major dimension or length, a much smaller minor dimension or width at the thickest part, and a smallest dimension or height, but may not be a true rectangle in cross section. Splines 30, as shown in FIGS. 3A-3C, have a slightly rounded upper surface. However, splines 30 may be, for example, oval or trapezoidal, as long as they can fit through an entrance 38 in spline groove 34 and fit in interior 42.

Spline grooves 34, however, are not conventional slot-shaped grooves but have a specific shape with a relatively smaller entrance 38 than their interior 42 and a pitch so that, when spline 30 is forced inside, it will press against an overhang 46 at the outward side of entrance 38. For example, spline groove 34 may be boot-shaped with the "toe" of the boot oriented outwards and downwards, as shown in FIGS. 3A-3C, so that spline 30 may be oriented to have its width against the "sole" of the boot. In this position, spline 30 holds the marginal portion of mesh screen 18 mechanically rather than frictionally. The position of spline 30, when seated, prevent it from coming out of entrance 38. Spline 30 will not come out of interior 42 of spline groove 34 by pulling on mesh screening 18, which, if made of a material such as nylon rather than fiberglass, must be cut to release it from base 22.

Still, the present safety barrier requires that base 22 itself not break free of framing 14. Accordingly, a central channel 50 is formed as part of base 22 and formed with plural holes 54 (FIGS. 3A-3C) for fasteners 58 such as screws. Moreover, a plate 62, made of metal and also formed with holes 66 that can be placed in registration with holes 54 in central channel 54 of base 22, is used as a washer for fasteners 58. Plate 62 serves as a washer in that it distributes the load placed on base 22 by the tightening of fasteners 58 over a greater area of central channel 50 so that damage to base 22 from tightening is minimized. Just as importantly, because plate 62 extends under other fasteners 58 as a unit rather than under just individual fasteners 58, it provides a more stable hold, even if some fasteners 58 pull loose, because it remains in place while other fasteners 58 are still tight.

Framing 14 is shown in cross-section in FIGS. 3A-3C, together with two splines 30 and mesh screen 18 over base 22. Mesh screen 18 is shown in an end view. Base 22 is shown attached to framing 14 with a fastener 58 running through plate 62 in central channel 50 and deep into framing 14.

Above base 22 is cap 26. Cap 26 carries on its underside two legs 72, each with a locking foot 74. Legs 72 are angled laterally outward. Central channel 50 is defined by two spaced apart walls 78 that are shared with spline grooves 34 and serve as the inner wall of spline grooves 34. Walls 78 have flanges 80 that extend inwardly from the tops of walls 78 to engage locking feet 74, as illustrated in FIG. 3C, when cap 26 is pressed onto base 22 to lock cap 70 onto base 22.

Cap 26 has trim flanges 82 that depend from its lateral ends and provide additional securement against the removal of mesh screen 18 by lateral force.

As tangential force is applied to mesh screen 18 in a direction indicated by the letter A as seen in FIG. 3C, spline 30 is compressed widthwise because it is softer than base 22 and presses against overhang 46. Further tension on mesh screen 18 pulls overhang 46 laterally but also causes the floor of base 40 to deform and squeeze spline 30 against the inner wall of interior 42. Also, trim flanges 82 may be lifted by the force on mesh screen 18 thereby forcing legs 72 to push harder against walls 78 of central channel. The combined resistance to lateral force on mesh screen 10, combined with its enhanced tensile strength, enables mesh screen in the infill to withstand perpendicular forces and not give way.

When introducing elements of the present disclosure or exemplary aspects or embodiment(s) thereof, the articles "a," "an," "the" and "said" are intended to mean that there are one or more of the elements. The terms "comprising," "including" and "having" are intended to be inclusive and mean that there may be additional elements other than the listed elements. Although this disclosure has been described with respect to specific embodiments, the details of these embodiments are not to be construed as limitations.

What is claimed is:

1. A safety barrier for a deck or porch, comprising:
framing defining an opening;
a base attached to said framing, said base having
at least one spline groove, said spline groove having an entrance and an interior,
a central channel adjacent to and parallel to said at least one spline groove, said central channel defined by at least one wall,
at least one spline, a spline of said at least one spline being in said spline groove of said at least one spline groove, and
a metal plate inserted into said central channel proximate said at least one wall, wherein said plate has a plurality of holes formed therein;
mesh screening having a marginal portion; and
a plurality of fasteners, each fastener of said plurality of fasteners being inserted through a respective hole of said plurality of holes in said metal plate and through said central channel of said base and into said framing, said metal plate extending as a unit under said plurality of fasteners, wherein said plurality of fasteners, said metal plate, and said at least one spline hold said base to said framing and said marginal portion of said mesh screening in said at least one spline groove.

2. The safety barrier as recited in claim 1, wherein said interior of said spline groove is wider than said entrance of said spline groove, and wherein said spline has a width, a height, and a length, and wherein said width and length of said spline are greater than said height of said spline and wherein said height of said spline is smaller than said entrance of said spline groove.

3. The safety barrier as recited in claim 1, wherein said mesh screening is made of nylon.

4. The safety barrier as recited in claim 1, further comprising a cap fastened to said base covering said at least one spline groove and said central channel.

5. The safety barrier as recited in claim 1, wherein said at least one wall is two walls, said two walls being spaced apart with said central channel therebetween, said base of said central channel having a plurality of holes formed therein for said plurality of fasteners.

6. The safety barrier as recited in claim 5, wherein said walls have locking flanges formed at the end thereof.

7. The safety barrier as recited in claim 6, further comprising a cap with two depending legs, said legs having locking feet, and wherein said locking feet of said cap lock to said locking flanges of said base to hold said cap to said base.

8. The safety barrier as recited in claim 1, wherein said mesh screening is made of a strands of a first material and strands of a second material, and wherein said first material and said second material have a different composition.

9. A safety barrier for a deck or porch, comprising:
framing defining an opening;
a base attached to said framing, said base having
at least one spline groove, said spline groove having an entrance and an interior,
a central channel adjacent to and parallel to said at least one spline groove, said central channel defined by two spaced apart walls, said two spaced apart walls having locking flanges,
at least one spline, a spline of said at least one spline being in said spline groove of said at least one spline groove, wherein said interior of said at least one spline groove is wider than said entrance of said at least one spline groove, and wherein said spline has a width, a height, and a length, and wherein said width and length of said spline are greater than said height of said spline and wherein said height of said spline is smaller than said entrance of said at least one spline groove; and
a metal plate inserted into said central channel proximate said two spaced apart walls, wherein said plate has a plurality of holes formed therein;
mesh screening having a marginal portion, said mesh screening being formed of first strands and second strands woven together, and wherein said first strands have a higher tensile strength than said second strands; and
fasteners inserted through said plurality of holes of said metal plate and said central channel of said base into said framing, wherein said at least one spline holds said marginal portion of said mesh screening in said at least one spline groove.

10. The safety barrier of claim 9, wherein said first strands have a different thickness than said second strands.

11. The safety barrier as recited in claim 9, wherein said first strands and said second strands have different compositions.

12. The safety barrier as recited in claim 9, further comprising a cap fastened to said base covering said at least one spline groove and said central channel.

13. The safety barrier as recited in claim 9, wherein said central channel having a plurality of holes formed therein for said fasteners.

14. The safety barrier as recited in claim 9, further comprising a cap with two depending legs, said legs having locking feet, and wherein said locking feet of said cap lock to said locking flanges of said base to hold said cap to said base.

15. A safety barrier for a deck or porch, comprising:
framing defining an opening;
a base attached to said framing, said base having at least one spline groove, said spline groove having an exterior wall and an interior wall, said exterior wall and said interior wall defining an entrance and an interior to said at least one spline groove, and a central channel parallel to said at least one spline groove and defined by said interior wall of said at least one spline groove and having a plurality of holes formed in said central channel, at least one spline, a spline of said at least one spline in said spline groove of said at least one spline groove, wherein said interior of said spline groove is wider than said entrance of said spline groove, and wherein said spline has a width, a height, and a length, and wherein said width and length of said spline are greater than said height of said spline and wherein said height of said spline is smaller than said entrance of said spline groove, and a cap attached to said base;

a metal plate having a plurality of holes formed therein and inserted into said central channel adjacent to said interior wall of said spline groove of said at least one spline groove, wherein said plurality of holes of said metal plate are in registration with said plurality of holes formed in said central channel;

mesh screening having a marginal portion; and fasteners inserted through said plurality of holes formed in said plate and said plurality of holes in said central channel of said base into said framing, wherein said at least one spline holds said marginal portion of said mesh screening in said at least one spline groove.

16. The safety barrier as recited in claim 15, wherein said exterior wall of said at least one spline groove has an overhang and wherein said at least one spline presses against said interior wall of said spline groove to resist removal of said mesh screen.

17. The safety barrier as recited in claim 15, wherein said mesh screen is made of nylon.

* * * * *